United States Patent [19]

Graham et al.

[11] 4,447,483

[45] May 8, 1984

[54] RETICULAR NEEDLEWORK FABRIC

[75] Inventors: William T. Graham, Verona; Gregory Wenkman, Dane, both of Wis.

[73] Assignee: W. T. Rogers Co., Madison, Wis.

[21] Appl. No.: 418,992

[22] Filed: Sep. 16, 1982

[51] Int. Cl.[3] ..... B32B 5/12

[52] U.S. Cl. ..... 428/105; 139/416; 425/190; 428/212; 428/213; 428/221

[58] Field of Search ..... 428/107, 108, 212, 213, 428/224, 257, 258, 259, 247, 255, 221; 139/416, 417, 407; 112/439; 425/190

[56] References Cited

U.S. PATENT DOCUMENTS

| | | | |
|---|---|---|---|
| 4,097,631 | 6/1978 | Wilken | 428/257 |
| 4,113,907 | 9/1978 | Haage et al. | 428/259 |
| 4,154,181 | 5/1979 | Massucci et al. | 112/439 |
| 4,197,345 | 4/1980 | Worrall | 428/258 |
| 4,369,816 | 1/1983 | Payen | 428/259 |

*Primary Examiner*—James J. Bell

*Attorney, Agent, or Firm*—Isaksen, Lathrop, Esch, Hart & Clark

[57] ABSTRACT

A reticular needlework fabric (10, 16) comprising a unitarily molded network of strands (12). The network has a plurality of spaced strands (12) extending parallel to a first axis, and a plurality of spaced strands (12) extending parallel to a second axis. A selected number of marker strands (14) are included among the strands (12) parallel to at least one axis. The marker strands (14) are separated from each other by a selected number of strands (12) and have molded-in features rendering them visually distinguishable from the remaining strands (12). The method of the invention for making such a reticular needlework fabric (10, 16) formed by channels (22) formed in at least one of the opposed faces (20) of a two-part mold (17) includes the steps of altering selected marker strand channels (24) so as to produce molded-in features in the marker strands (14) molded therein, rendering them visually distinguishable from the remaining strands (12). Additional steps include closing the mold (17), filling the mold with selected molten plastic, cooling the plastic sufficiently to solidify it, and opening the mold (17) and removing the needlework fabric (10, 16) therefrom.

9 Claims, 4 Drawing Figures

RETICULAR NEEDLEWORK FABRIC

TECHNICAL FIELD

This invention relates to fabrics for needlework in general, and in particular, to fabrics unitarily molded from plastics.

TECHNICAL BACKGROUND

In needlework, selected yarns or threads are sewn onto a reticular base fabric to create the desired pattern. Historically, such base fabrics were canvases made of natural fibers and having a regular, open weave. To produce geometrical patterns or in copying a master pattern onto the canvas, the craftsman maintained uniformity in the design by counting the threads that had been woven to form the regular, reticulate canvas.

Reticulate needlework fabrics molded from polyethylene and other plastics have been developed to replace woven natural canvases for use as needlework base fabrics. Molded plastic fabrics may be made with precisely controlled dimensions, so that the molded plastic strands forming the reticular fabric are equally spaced and intersect at right angles. Consequently, patterns made on such fabrics by counting strands are regular and true.

Counting strands as part of the needlework process is tedious work and requires extreme attention in order to avoid error. Consequently, methods have been developed to help in the counting process or to avoid it altogether. Thus, the prior art is cognizant of various ways to transfer to a fabric designs to be created thereon by the needlework process. Examples include U.S. Pat. Nos. 4,090,300; 4,154,181; and 4,239,011. In the patents cited, a removable paper or transparent pattern is held in place over the fabric to guide the craftsman as the desired design is produced. U.S. Pat. No. 3,779,190 teaches a method of "tramming" or serving secondary colored threads into conventional canvas as a first step in needlework, the threads serving as a guide to the craftsman. U.S. Pat. No. 1,185,245 teaches the printing of dots on fabric to guide a craftsman in smocking the fabric. Printing such patterns on fabrics made of polypropylene or other plastics has presented difficulties, as is noted in U.S. Pat. No. 4,154,181 at column 1, line 66, because ink does not adhere readily to such materials. And in any event, marking selected strands of the fabric by imparting a contrasting color to them requires employing an additional step in manufacturing and ensuring by some means that the contrasting color is not visible once the needlework is completed through or between the yarns or threads sewn onto the base fabric.

BRIEF SUMMARY OF THE INVENTION

The present invention is summarized in that a reticular fabric for needlework includes a plurality of spaced strands extending parallel to a first axis, and a plurality of spaced strands extending parallel to a second axis. A selected number of marker strands are included among the strands parallel to at least one axis and are separated from each other by a selected number of strands. The marker strands have molded-in features rendering them visually distinguishable from the remaining strands.

The method of the invention for making a reticular needlework fabric having a unitarily molded network of strands including a plurality of strands extending parallel to a first axis and a plurality of strands extending parallel to a second axis, the strands being formed by channels formed in at least one of the opposed faces of a two-part mold, includes altering selected channels so as to produce molded-in features in the strands molded therein rendering the strands visually distinguishable from the remaining strands. The method further includes closing the mold, filling the mold with a selected molten plastic, cooling the plastic sufficiently to solidify it, and opening the mold and removing the needlework fabric therefrom.

A primary object of the invention is to provide a reticular needlework fabric unitarily molded from plastic in which selected strands of the fabric are visually distinct from the remaining strands.

A second object of the invention is to provide such a fabric in which the selected strands are made visually distinguishable from the remaining strands without the use of ink or other means for altering the color of the selected strands.

Another object of the invention is to provide such a fabric wherein the selected strands are rendered visually distinguishable from the remaining strands in such a way that, while the selected strands are apparent in the fabric before the needlework is completed, they are easily obscured by the yarns or threads woven into the fabric in the process of completing the needlework.

A further object of the invention is to provide such a fabric and a method of making it in which the selected strands are formed as part of the molding process without the need for any separate manufacturing step to mark or otherwise alter their appearance.

Other objects, features, and advantages of the invention will be apparent from the following detailed description taken in conjunction with the accompanying drawings showing preferred embodiments of the reticular needlework fabric of the invention and of molds adapted to produce the fabric.

DETAILED DESCRIPTION OF THE PREFERRED EMBODIMENT

Figure 1:
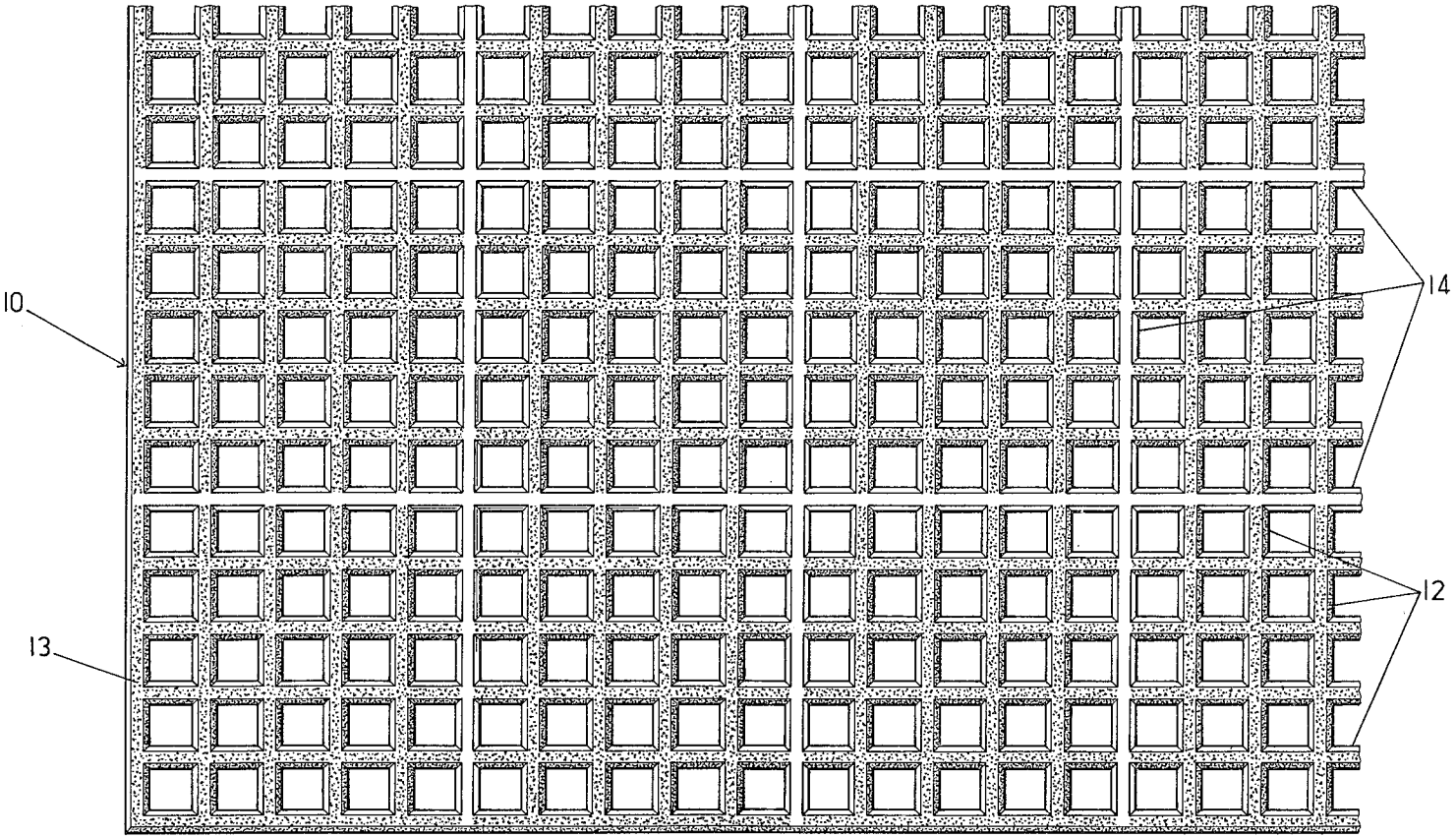
FIG. 1 is a plan view of reticular needlework fabric made in accord with the present invention.

Referring more particularly to the drawings, wherein like numbers refer to like parts, FIG. 1 shows a preferred embodiment of a reticular needlework fabric made in accord with the present invention, shown generally at 10. The needlework fabric 10 has a network of strands 12 including a plurality of spaced strands extending parallel to a first axis and a second plurality of spaced strands extending parallel to a second axis and intersecting those parallel to the first axis. Preferably, the first and second axes are oriented at a right angle to each other, although fabrics having axes of differing orientation are possible and would be within the scope and spirit of the invention. Preferably the strands 12 are coplanar and are rigidly engaged at all points of intersection.

A selected number of marker strands 14 are included among the strands 12. Marker strands 14 may be included among those strands 12 parallel to the first axis, among those parallel to the second axis, or both. The marker strands 14 parallel to a given axis are separated from each other by a selected number of the remaining strands 12. Preferably, every fifth strand 12 or every tenth strand is a marker strand 14, although different spacing is possible and would be within the scope and spirit of the invention.

The marker strands 14 have molded-in features rendering them visually distinguishable from the remaining strands 12. The marker strands 14 of the embodiment of the reticular needlework fabric 10 of the invention shown in FIG. 1 have a visually distinguishable difference in surface smoothness when compared with the remaining strands 12. Preferably, the marker strands 14 have a smoothness greater than that of the remaining strands 12, and preferably the difference in smoothness is such that the marker strands appear glossy or shiny in comparison to the remaining strands. As can be seen with reference to FIG. 1, except for the molded-in visually distinguishable difference in surface smoothness, the marker strands 14 and remaining strands 12 are otherwise substantially similar to each other.

The needlework fabric 10 is substantially planar and thus has a first side 13 and a second side (not shown). In certain applications, it is advantageous that the visually distinguishable characteristic of the marker strands 14 be visible from only one of the first 13 and second sides. In such cases, the visually distinguishable difference in surface smoothness is molded into only selected parts of the marker strands 14 and is limited to parts visible from only one of the first 13 and second sides.

Preferably, the marker strands 14 include a selected number of marker strands parallel to each axis and separated from each other by the same number of remaining, unmarked strands 12. Thus, the fabric 10 has an appearance to the user comparable to that presented by conventional graph paper. A pattern drawn on graph paper may then be readily followed by a user of the fabric 10, who is guided by the corresponding patterns of visually distinguishable lines and strands 14. In any event, a user of the fabric 10 engaged in counting strands 12 of the fabric, a customary technique in counted cross-stitch, needlework, and the like, may count the strands by groups instead of individually. Thus, the user of a fabric 10 in which the marker strands 14 constitute every tenth strand 12 can count by tens, and the user of a fabric in which the marker strands appear evey fifth strand can count by fives, and so on. Much time can be saved and tedium and mistakes avoided.

Figure 2:
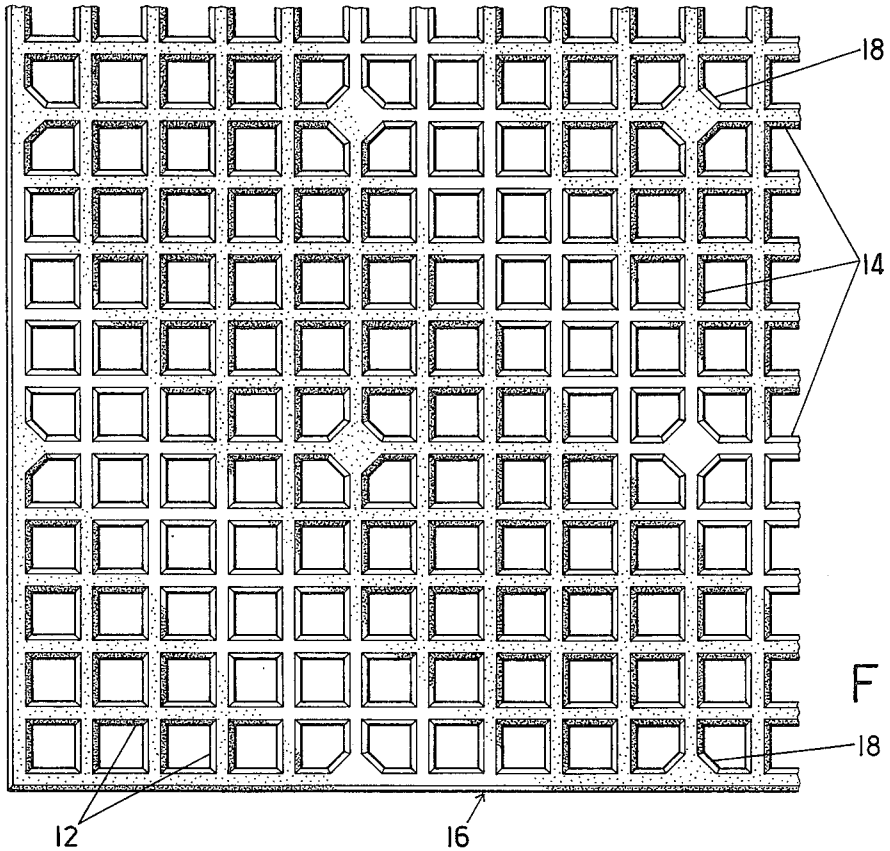
FIG. 2 is a plan view of a second embodiment of the needlework fabric of the invention.

A second embodiment of a reticular needlework fabric made in accord with the invention is shown generally in FIG. 2 at 16. Parts corresponding to those of the embodiment shown at 10 in FIG. 1 are given like numbers and will not be separately discussed. The marker strands 14 of the second embodiment shown at 16 may have the same surface smoothness as that of the remainder of the strands 12. The cross sectional configuration of the strands 12 is substantially uniform over their lengths. The marker strands 14 are rendered visually distinguishable from the remaining strands 12 by a molded-in variation in at least one selected portion 18 of each marker strand such that that portion 18 has a cross sectional dimension differing from those of the remaining strands. Preferably the selected portion 18 is wider than the remaining parts of the strands 12. Widened portions 18 may appear only at the margin of the fabric 16 or, as is preferred, both at the margins and at each intersection of marker strands 14, as is shown in FIG. 2. As can be seen in FIG. 2, except for the widened portions 18, the marker strands 14 and remaining strands 12 are otherwise substantially similar to each other. Marker strands 14 so rendered visually distinctive offer the same advantages and functions as those made visually distinctive by differences in surface smoothness.

Needlework fabric 10, 16 made in accord with the invention preferably is molded from a selected plastic. It is desirable that the plastic be flexible, tough, substantially white or colorless, and capable of maintaining its physical dimensions at the range of temperatures appropriate for normal living conditions. Polypropylene has proved an advantageous plastic for this use and is preferred. However, other plastics and other materials suitable for molding a network of strands are possible and are within the scope and spirit of the invention.

Figure 3:
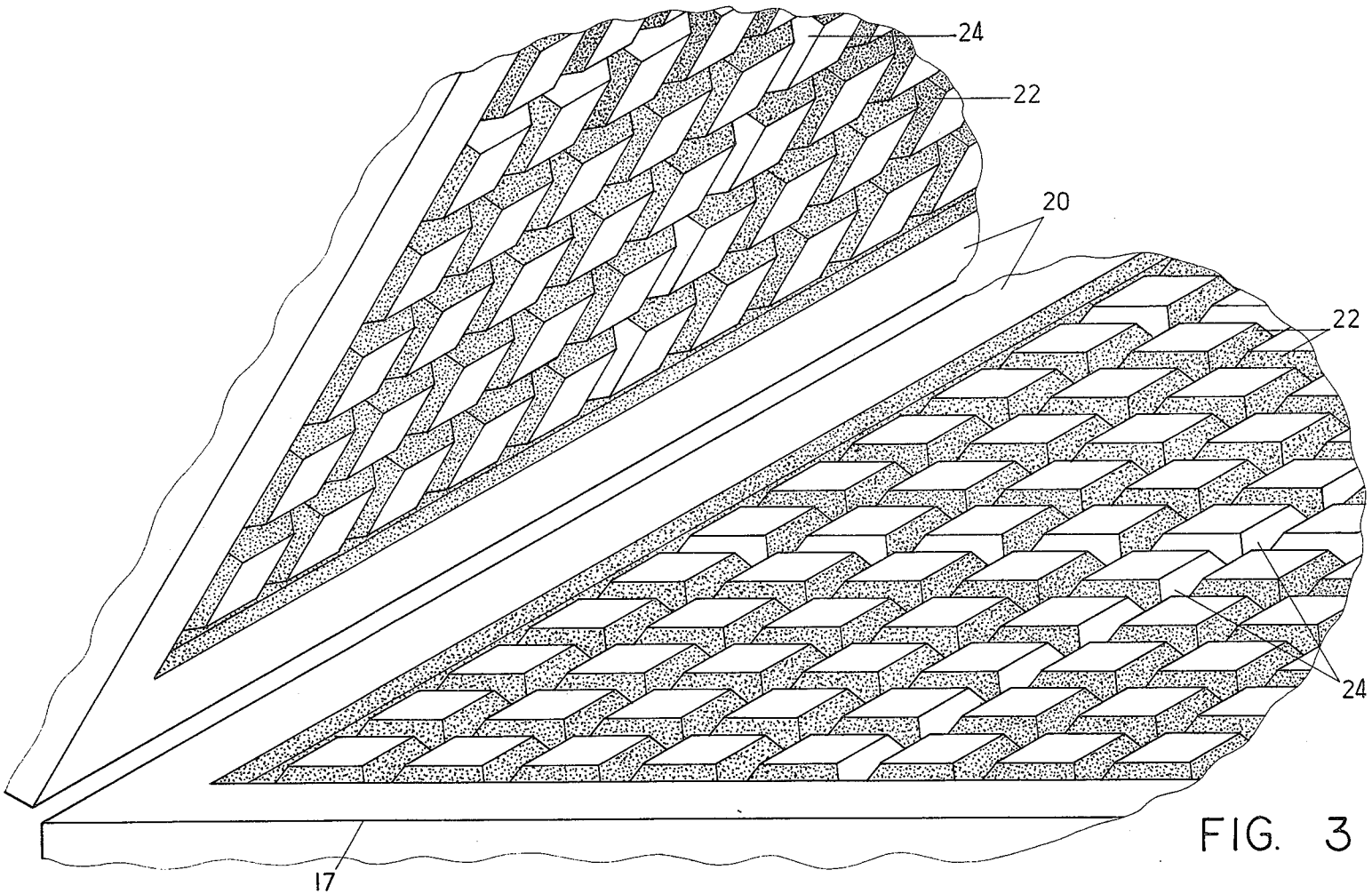
FIG. 3 is an isometric perspective view of a mold adapted for the manufacture of the needlework fabric shown in FIG. 1.
Figure 4:
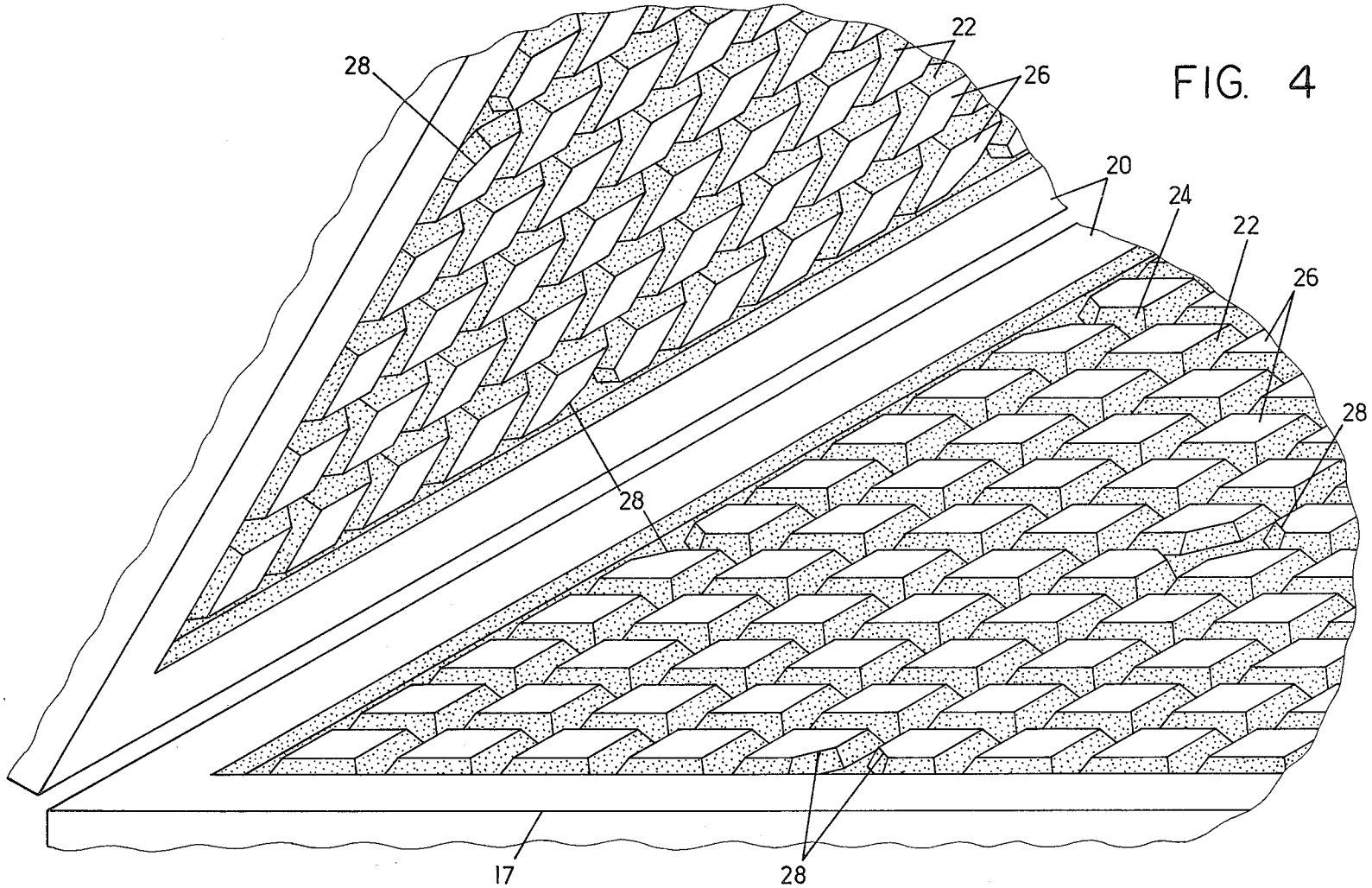
FIG. 4 is a mold adapted for the manufacture of the needlework fabric shown in FIG. 2.

The method of the invention for making a reticular needlework fabric of the sorts described above employs a mold. Preferably, the mold is a plastic injection mold of the sort shown in FIGS. 3 and 4 at 17, having opposed faces 20. At least one of the opposed faces 20 and preferably both of them have channels 22 in which the strands 12 of the fabric 10, 16 are formed.

Selected marker strand channels 24 are altered so as to produce molded-in features in the strands molded therein, rendering them visually distinguishable from the remaining strands 12, so as to function as marker strands 14. Preferably, selected portions of the surfaces of the marker strand channels 24 are given a surface finish contrasting to that of the surfaces of the remaining channels 22. Preferably, the surfaces of the marker strand channels 24 are polished to a higher degree than those of the remaining channels 22, so that the marker strands 14 that are molded therein are distinctively smooth when compared to the remaining strands 12 molded by the remaining channels 22, to produce a fabric 10 such as that shown in FIG. 1. If marker strand channels 24 of only one face 20 are so polished, the marker strands 14 produced thereby will be visually distinctive only on one side of the fabric 10 manufactured in the mold 17.

The channels 22 formed in the opposed faces 20 of a mold 17 of the sort referred to above are separated by opposed mounts 26. The mounts 26 are adapted to be pressed together when the mold 17 is closed, to form a void in the fabric being molded therein. The step of altering selected channels alternatively includes the step of removing a selected portion of a mount 26 adjacent to each marker strand channel 24 to form a wider portion, as is shown at 28 in FIG. 4. When the mold 17 is closed and filled with plastic, the plastic fills the marker strand channels 24 and the remaining channels 22, as well. The wider portions 28 left as a consequence of the removal of a selected portion of the mounts 26 also fills with plastic, making the marker strand 14 formed by the marker strand channel 24 wider at that point. By this means, the marker strand 14 is made visually distinguishable from the remaining strands 12, having a cross sectional shape at that point different from that of the remainder of the strands 12, to produce a fabric 16 such as that shown in FIG. 2.

After the selected marker strand channels 24 are altered so as to produce molded-in features in the strands 14 molded therein rendering them visually distinguishable from the remaining strands 12, the mold 17 is closed and filled with molten plastic. The plastic is cooled sufficiently to solidify it. Then the mold 17 is opened and the needlework fabric 10, 16 is removed therefrom.

Although the means of rendering the marker strands 14 visually distiguishable from the remaining strands 12 disclosed above are the preferred embodiments of the invention, any molded-in features that render the marker strands so distinguishable are within the scope and spirit of the invention. Thus, the marker strands 14 could be molded with angular, flat faces, while the remaining strands 12 are made rounded and smooth. Many such differences in cross sectional configuration could be employed in practicing the invention. Likewise, marker strands 14 could be made distinctively narrower at given points in order to render them visually distinctive. Marker strands 14 could be molded so as to be less smooth rather than more smooth than the remaining strands 12. Every fifth strand 12 could be rendered visually distinctive by one means and every tenth strand could be so rendered distinctive by a second means. The molded-in features of the marker strands 14 could be so distributed as to provide the outline of a figure to be created by needlework or the like on the fabric 10, 16.

All of these modified forms, as well as the preferred embodiments disclosed above may be unitarily and therefore economically molded from inexpensive and available plastics. Furthermore, the marker strands 14 may be made visually distinquishable without the use of ink or other means for altering their color. Thus, plastics such as polypropylene that are not easily colored may nevertheless be used to manufacture a marked needlework fabric. Furthermore, while the marker strands 14 are visually distinguishable from the remaining strands 12 before the needlework has begun, they bear no marks or colors that are not easily obscured by the yarns or threads woven into the fabric by the user as the needlework is done, there being no color to show through light colored yarns or to show between any thread or yarn. Furthermore, when the visually distinctive aspect of the marker strands 14 is made visible from only one side of the fabric, that side may be made the rearward side of the finished needlework, so that the visually distinctive aspect of the marker strands 14 is entirely obscured to a viewer of the finished needlework.

It is understood that the present invention is not limited to the particular construction or arrangement of parts illustrated and disclosed nor to the particular steps disclosed herein. Instead, it embraces all such modified forms thereof as come within the scope of the claims.

What is claimed is:

1. A reticular needlework fabric (10, 16) adapted to receive needlework yarns, comprising a unitarily molded network of strands (12) having (a) a plurality of spaced strands (12) extending parallel to a first axis;

(b) a plurality of spaced strands (12) extending parallel to a second axis; and (c) a selected number of marker strands (14) included among the strands (12) parallel to at least one axis, separated from each other by a selected number of strands (12) and having molded-in features rendering them visually distinguishable from the remaining strands (12), such features being adapted to be substantially obscured after application of the needlework yarns.

2. The reticular needlework fabric (10, 16) specified in claim 1 wherein marker strands (14) are included among the strands (12) parallel to both axes.

3. The reticular needlework fabric (10) specified in claim 1 or claim 2 wherein the molded-in features that render the marker strands (14) visually distinguishable from the remaining strands (12) include a visually distinguishable difference in surface smoothness of a selected part of the marker strands (14) as opposed to the remaining strands (12) and wherein the marker strnds (14) and remaining strands (12) are otherwise substantially similar to each other.

4. The reticular needlework fabric (10) specified in claim 3 wherein the selected parts of the marker strands (14) have a visually perceivable, molded-in smoothness greater than the smoothness of the remaining strands (12).

5. The reticular needlework fabric (10) specified in claim 3 wherein the fabric (10) has a first side (13) and a second side, and the selected parts of the marker strands (14) are visible from only one of the first (13) and second sides.

6. The recticular needlework fabric (16) specified in claim 1 or claim 2 wherein the cross sectional configuration of the strands (12) is substantially uniform over their lengths, and wherein the molded-in features rendering the marker strands (14) visually distinguishable from the remaining strands (12) include at least one selected portion (18) of each marker strand (14) having cross sectional dimensions differing from those of the remaining strands (12) the marker strands (14) and remaining strands (12) being otherwise substantially similar to each other.

7. The reticular needlework fabric (16) specified in claim 6 wherein the selected portion (18) having cross sectional dimensions differing from those of the remaining stands (12) is wider than the remaining strands (12).

8. The recticular needlework fabric (10, 16) specified in claim 1 or claim 2 wherein the needlework fabric (10, 16) is molded from a selected plastic.

9. The reticular needlework fabric (10, 16) of claim 8 wherein the plastic is polypropylene.

* * * * *